US008256753B2

(12) United States Patent
Teo

(10) Patent No.: US 8,256,753 B2
(45) Date of Patent: Sep. 4, 2012

(54) HIGH-DENSITY FIXTURE VISE

(75) Inventor: Rene Teo, Longmont, CO (US)

(73) Assignee: Productivity Systems, LLC, Boulder, CO (US)

( * ) Notice: Subject to any disclaimer, the term of this patent is extended or adjusted under 35 U.S.C. 154(b) by 589 days.

(21) Appl. No.: 12/486,177

(22) Filed: Jun. 17, 2009

(65) Prior Publication Data

US 2010/0320666 A1 Dec. 23, 2010

(51) Int. Cl.
*B25B 1/20* (2006.01)

(52) U.S. Cl. ..... 269/43; 269/32; 269/254 CS; 269/280; 269/240

(58) Field of Classification Search ..... 269/32, 269/43, 254 CS, 280, 240, 45, 309–310
See application file for complete search history.

(56) References Cited

U.S. PATENT DOCUMENTS

| | | | | | |
|---|---|---|---|---|---|
| 744,559 | A | * | 11/1903 | Kendrick | 409/225 |
| 1,994,422 | A | * | 3/1935 | Sasek | 269/309 |
| 2,893,275 | A | * | 7/1959 | Lindemann | 269/310 |
| 3,397,880 | A | * | 8/1968 | Kuban | 269/240 |
| 3,901,488 | A | * | 8/1975 | Riddle | 266/274 |
| 4,413,818 | A | | 11/1983 | Lenz | |
| 4,413,819 | A | | 11/1983 | Lenz | |
| 4,529,183 | A | * | 7/1985 | Krason et al. | 269/43 |
| 4,532,716 | A | | 8/1985 | Steiner | |
| 4,734,000 | A | | 3/1988 | Lenz | |
| D302,654 | S | | 8/1989 | Cetrone | |
| 4,923,186 | A | | 5/1990 | Durfee, Jr. | |
| 4,934,674 | A | | 6/1990 | Bernstein | |
| D309,701 | S | | 8/1990 | Newmeyer et al. | |
| 4,949,943 | A | | 8/1990 | Bernstein | |
| D317,116 | S | | 5/1991 | Nimtz | |
| 5,013,017 | A | | 5/1991 | Swann | |
| 5,022,636 | A | | 6/1991 | Swann | |
| 5,024,427 | A | * | 6/1991 | Swann | 269/136 |
| 5,037,075 | A | | 8/1991 | Durfee, Jr. | |
| 5,054,970 | A | | 10/1991 | Steiner | |
| 5,065,990 | A | | 11/1991 | Durfee | |
| D322,390 | S | | 12/1991 | Nimtz et al. | |
| 5,098,073 | A | | 3/1992 | Lenz | |
| 5,129,638 | A | | 7/1992 | Durfee, Jr. | |
| 5,133,135 | A | | 7/1992 | Durfee, Jr. | |
| 5,150,888 | A | | 9/1992 | Durfee | |
| 5,178,431 | A | * | 1/1993 | Voellmer | 294/86.4 |
| 5,197,169 | A | * | 3/1993 | Gordon | 27/27 |
| 5,242,159 | A | | 9/1993 | Bernstein | |
| 5,310,299 | A | | 5/1994 | Bernstein | |
| D359,294 | S | | 6/1995 | Szabo | |
| D359,295 | S | | 6/1995 | Szabo | |
| D359,970 | S | | 7/1995 | Szabo | |
| 5,458,321 | A | | 10/1995 | Durfee, Jr. | |

(Continued)

*Primary Examiner* — George Nguyen
(74) *Attorney, Agent, or Firm* — Marsh Fischmann & Breyfogle LLP

(57) ABSTRACT

A multi-station machine vise that is disclosed herein that utilizes soft jaws, which are symmetrical and machineable on all four sides. The jaws being identical in size and configuration makes them interchangeable/usable on any vise station, which results in reduced operating costs. The movable jaws are precisely located and fastened to the vise utilizing a jaw carrier, which incorporates a pull-down action to eliminate jaw lift. The jaw carrier includes a downwardly positioned wedge design that engages a corresponding wedge on a slide that moves the jaw carrier and the jaw. Incorporating the pull-down mechanism into the jaw carrier disposed between and slide and the jaw allows for simplifying the design and manufacture of the jaws.

19 Claims, 8 Drawing Sheets

U.S. PATENT DOCUMENTS

D367,485 S 2/1996 Szabo et al.
5,501,123 A 3/1996 Swann et al.
5,526,715 A 6/1996 Swann et al.
5,535,995 A 7/1996 Swann et al.
5,544,988 A * 8/1996 Liu ..... 408/90
5,562,277 A 10/1996 Swann et al.
5,613,812 A 3/1997 Levan et al.
5,623,754 A 4/1997 Swann et al.
5,623,757 A 4/1997 Durfee, Jr.
5,634,253 A 6/1997 Swann
5,641,257 A 6/1997 Bernstein
5,649,694 A * 7/1997 Buck ..... 269/43
5,669,807 A * 9/1997 Moreau et al. ..... 451/460
5,720,476 A 2/1998 Swann et al.
5,735,514 A 4/1998 Moore et al.
5,762,326 A 6/1998 Swann
5,806,841 A 9/1998 Hebener
5,893,551 A * 4/1999 Cousins et al. ..... 269/43
5,921,534 A 7/1999 Swann et al.
5,921,536 A 7/1999 Bernstein
5,971,380 A 10/1999 Hebener
5,975,513 A 11/1999 Wolfe
D417,599 S 12/1999 Wolfe et al.
6,012,712 A 1/2000 Bernstein
6,017,026 A * 1/2000 Durfee, Jr. ..... 269/271
6,019,358 A 2/2000 Bernstein
6,022,010 A 2/2000 Bernstein
6,029,967 A 2/2000 Wolfe
6,079,704 A * 6/2000 Buck ..... 269/242
6,217,014 B1 * 4/2001 Wolfe ..... 269/43
6,240,807 B1 6/2001 Hebener et al.
6,250,620 B1 6/2001 Durfee, Jr.
6,322,299 B1 11/2001 Hartman
6,361,034 B1 3/2002 Wolfe
6,409,161 B1 6/2002 Wolff et al.
6,641,128 B2 * 11/2003 Fries ..... 269/309
6,948,424 B2 9/2005 Schroeder et al.
7,000,897 B2 2/2006 Chick
7,011,018 B2 3/2006 Schroeder et al.
7,077,608 B2 7/2006 Hartman
7,163,201 B2 1/2007 Bernstein
7,382,145 B2 * 6/2008 Thurmaier ..... 324/756.04
7,404,769 B2 * 7/2008 Dilling ..... 470/63
2003/0062665 A1 * 4/2003 Urlaub ..... 269/309
2005/0281631 A1 12/2005 Bernstein
2006/0013648 A1 1/2006 Bernstein
2008/0271576 A1 * 11/2008 Hsieh ..... 81/121.1

* cited by examiner

HIGH-DENSITY FIXTURE VISE

FIELD OF INVENTION

The invention relates to a vise used in precision machining processes. More specifically, the invention is directed to a multi-station machine vise that reduces or eliminates jaw lift without requiring intricately designed jaws.

BACKGROUND OF THE INVENTION

Multi-station (e.g., dual-station) precision machining vises are known in the art. Typically, such multi-station machining vises include first and second movable jaws that are disposed on opposing sides of a stationary jaw. A drive mechanism advances each of the movable jaws to and/or away from the stationary jaw to clamp workpieces within the vise.

Often, it is desirable to hold irregular shaped workpieces within such a vise. Accordingly, many precision machining vises now utilized what may be termed 'soft jaws' which are adapted to that may be milled to conform to the surface of the workpiece that they are to hold. In this regard, after a soft jaw is milled for a particular workpiece, the jaw may not have functionality for use with other workpieces. That is, after milling for particular application, soft jaws are often replaced or stored for repeat use in the future.

For precision milling purposes, it is important that workpieces are maintained or repeatably located within strict tolerances. One complicating factor for maintaining such strict tolerances of the workpieces is a tendency for a movable jaw to lift as the jaw compresses a workpiece relative to the stationary jaw. Such 'jaw-lift' may result in, for example, a workpiece being slightly out of position relative to a known coordinate location of a CNC milling machine.

To counteract the effect of jaw lift, some prior art machining vises provide a hold-down or pull-down force to the forward edge of the movable jaw. However, the design of such prior art machining vises that provide such a pull-down force often require intricately designed jaws having specialized recessed lower surfaces. In addition, such specialized jaws often have a high profile, or in some instances, a relatively thin layer of metal over the recess, which restricts the depth of contouring that can be done for holding workpiece on the top of the movable jaw.

It is against this background that the present disclosure is provided.

SUMMARY OF THE INVENTION

Provided herein are multi-station machine vises that may utilize soft jaws, which in one aspect are symmetrical and machineable on all four sides. The jaws being identical in size and configuration makes them interchangeable/usable on any vise station, which results in reduced operating costs. In a further aspect, the movable jaws are precisely located and fastened to the vise utilizing a jaw carrier, which incorporates a pull-down action to eliminate jaw lift. The jaw carrier includes a downwardly positioned wedge design that engages a corresponding wedge on a slide that moves the jaw carrier and the jaw. Incorporating the pull-down mechanism into the jaw carrier disposed between the slide and the jaw allows for simplifying the design and manufacture of the jaws.

According to a first aspect of the invention, a machine vise is provided that allows for substantially eliminating jaw lift caused by tightening a movable jaw relative to a stationary jaw while an element is compressed between these jaws. Typically, the vise includes a base having recess that defines the longitudinal axis. The bottom surface of the base also defines a reference plane. A stationary jaw is removably mounted to the base. The stationary jaw is typically mounted relative to a top surface of the base above the recess. A first slide is disposed in the recess for selective movement along the longitudinal axis. A drive screw or other actuator may effect movement of the first slide. The slide is utilized to move a jaw to and away from the stationary jaw. More specifically, the slide includes a body and a slide carrier head that extends above the body. In this particular arrangement, the slide carrier head includes an undercut lip. A jaw carrier is also provided as a recess in its lower surface that is sized to receive the slide carrier head. This recess includes an overcut lip for complimentary engagement with the undercut lip of the slide carrier head. This first jaw carrier also includes an upper surface having an outside peripheral edge. A first jaw of the vise has a recess in its bottom surface that is sized to conformably receive the outside peripheral edge of an upper surface of the first jaw carrier. The complimentary engagement of the overcut lip with the undercut lip, which is sometimes defined as wedge surfaces, provides a pull-down effect between the slide and the jaw carrier as the vise is tightened. The conformal fit of the jaw carrier into the recess in the bottom surface of the first jaw transfers the pull-down effect from the jaw carrier to the jaw without the jaw requiring an undercut recess in its bottom surface.

In one arrangement, the inside edge surfaces of the recess in the bottom surface of the first jaw are substantially perpendicular to the bottom surface of the first jaw. That is, they are free of any undercutting. In one arrangement, the outside peripheral edge of the jaw carrier is likewise substantially perpendicular to the bottom surface of the jaw when the jaw carrier is engaged with the jaw. In one arrangement, a tolerance between the outside peripheral edge of the upper surface of the jaw carrier and the mating inside portions of the recess of the jaw are about 1 mil. or 0.001 inches. In one arrangement, a fastener (e.g., bolt or screw) fixedly connects the jaw to the jaw carrier.

Due to the simplified nature of the recess in the bottom of the jaw, the jaws are very easy to manufacture. That is, unlike a jaw having an undercut recess in its bottom surface that requires more complex milling, the substantially perpendicular edge surfaces of the recess permit the jaws of the present aspect to be readily machined. This allows most machine shops to readily and efficiently produce their own replacement jaws for the vise. That is, unlike soft jaws that utilize specialized undercut recesses to provide pull-down effect, here the pull-down effect is provided between two parts of the vise. Specifically, the pull-down effect is provided between the slide and the intermediate jaw carrier. Accordingly, the slide and the jaw carrier may be made of very durable materials such as, for example, stainless steels. This permits the soft jaws to be produced of much softer materials such as aluminums and mild steels.

In one arrangement, the outside peripheral edge of the jaw carrier and the recess in the jaw permit the jaw to engage the carrier in multiple orientations. For instance, the jaw carrier may be rectangular. Correspondingly, the recess in the bottom of the jaw may be a cruciform recess that is operative to receive the rectangular/oblong jaw carrier along first and second axes. This may permit orienting different faces of the jaw towards the stationary jaw during use of the vise. It will be appreciated that the jaw carrier may also include, for example, a square peripheral edge (or other geometric shape—hexagonal, octagonal, etc.), and the jaw may have a correspondingly shaped recess that would likewise allow for engaging the jaw in different orientations relative to the slide carrier.

In one arrangement, the vise is a multiple station vise where first and second movable jaws move relative to the stationary jaw. These jaws may be disposed on opposing sides of the stationary jaw and may operate together to clamp one or more work pieces between the respective movable jaw and the stationary jaw. In such an arrangement, a second slide is disposed in the recess that engages a second jaw carrier that is received within a recess in the bottom of the second jaw. The second slide may include a head having an overcut lip that is received within a recess in the second jaw carrier having a complimentary undercut lip to provide pull-down effect for the second jaw.

In another aspect of the present invention, a dual station machining vise is provided that permits the interchange of any of the jaws with any of the other jaws. That is, the movable jaws and the stationary jaw of the vise are interchangeable such that only a single jaw style need be produced and/or inventoried for the vise.

The dual station vise includes a base having a recess that defines a longitudinal axis. A stationary jaw is removably mounted to the base and disposed over a portion of the recess. First and second slides are movably disposed in the recess on opposing sides of the stationary jaw. Each slide includes a head portion having an undercut lip. The vise also includes first and second jaw carriers that include recessed lower surfaces for receiving the head portion of the slides. These recessed lower surfaces include a lip for complimentary engagement with a mating lip of the corresponding slide. First and second jaws are mounted to the first and second jaw carriers. In one arrangement, these jaws include recesses in their bottom surface for conformably receiving an outer periphery of a respective one of the jaw carriers. The recesses in the first and second jaws may include edge surfaces that are substantially perpendicular to the bottom surface of the jaw and which are free of undercutting.

In one arrangement, the vise further includes a mounting element that is mounted to the base for locating the stationary jaw. In such an arrangement, the stationary jaw includes a recess in its bottom surface for conformably receiving the mounting element. In this arrangement, the mounting element may be sized identically to the size and shape of the first and second jaw carriers. In this regard, the recess in the bottom of the stationary jaw may be substantially identical to the recess in the bottom of the first and second movable jaws. Stated otherwise, all three jaws—the two movable jaws and the stationary jaw—may be identically configured in size, shape and include a common recess for receiving either a jaw carrier or the locating element for the stationary jaw.

In another aspect of the present invention, a dual station machining vise is provided that allows for selectively moving one of two movable jaws prior to initiating movement of the other jaw. The vise includes a base having a recess and a stationary jaw removably mounted to the base over a portion of the recess. First and second slides are mounted in the recess on opposing sides of the stationary jaw. A biasing block is disposed in the recess below the stationary jaw and between the first and second slides. Biasing elements are disposed between the biasing block and the first and second slides, respectively. A locating assembly allows for moving the biasing block towards one of the slides and maintaining the block in this location. This allows for compressing one of the biasing elements (e.g., springs) to a greater extent than the other biasing element. A drive screw extends through a first end of the base, passes through an aperture in the first slide and is received in a first threaded portion of the second slide. The drive screw typically does not engage the aperture of the first slide but rather, a head of the drive screw or bushing provides a contact interface between the drive screw and the first slide. When the drive screw is threaded into the second slide, the first and second slides are compressed towards one another. However, until the tension between the first and second biasing elements is equal, one of the slides and associated jaws will move before the other slide and jaw.

The selective movement of one of the jaws in relation to the other provides what may be termed as a "third hand." That is, a user may selectively open one of the jaws prior to opening the other jaw to facilitate removal and/or engagement of elements within the machining vise.

The locating assembly for locating the biasing block in a position along the length of the recess may be any element or combination of elements that permits affixing the position of the biasing block. In one arrangement, an elongated aperture is disposed through a portion of the base that defines the recess and a threaded element such as a bolt or screw passes through this elongated aperture and engages a threaded aperture within the biasing block. Accordingly, by tightening the threaded element when the block is in a desired location (e.g., which may include compressing one of the biasing elements), the position of the biasing block can be affixed.

In a further arrangement, the use of the drive screw which passes through one of the slides without threaded engagement allows for fixing the position of the slide having the threaded aperture to transform the multi-station vise into a single station vise. For instance, in one arrangement a threaded element (e.g., bolt or screw) may extend through a second end of the vise and engage the slide that is in threaded engagement with the drive screw. Accordingly, this slide may be affixed relative to the base such that the subsequent turning of the drive screw only moves the slide with the non-threaded aperture.

BRIEF DESCRIPTION OF THE DRAWINGS

For a more complete understanding of the present invention and further advantages thereof, reference is now made to the following detailed description taken in conjunction with the drawings in which.

DETAILED DESCRIPTION

Figure 1:
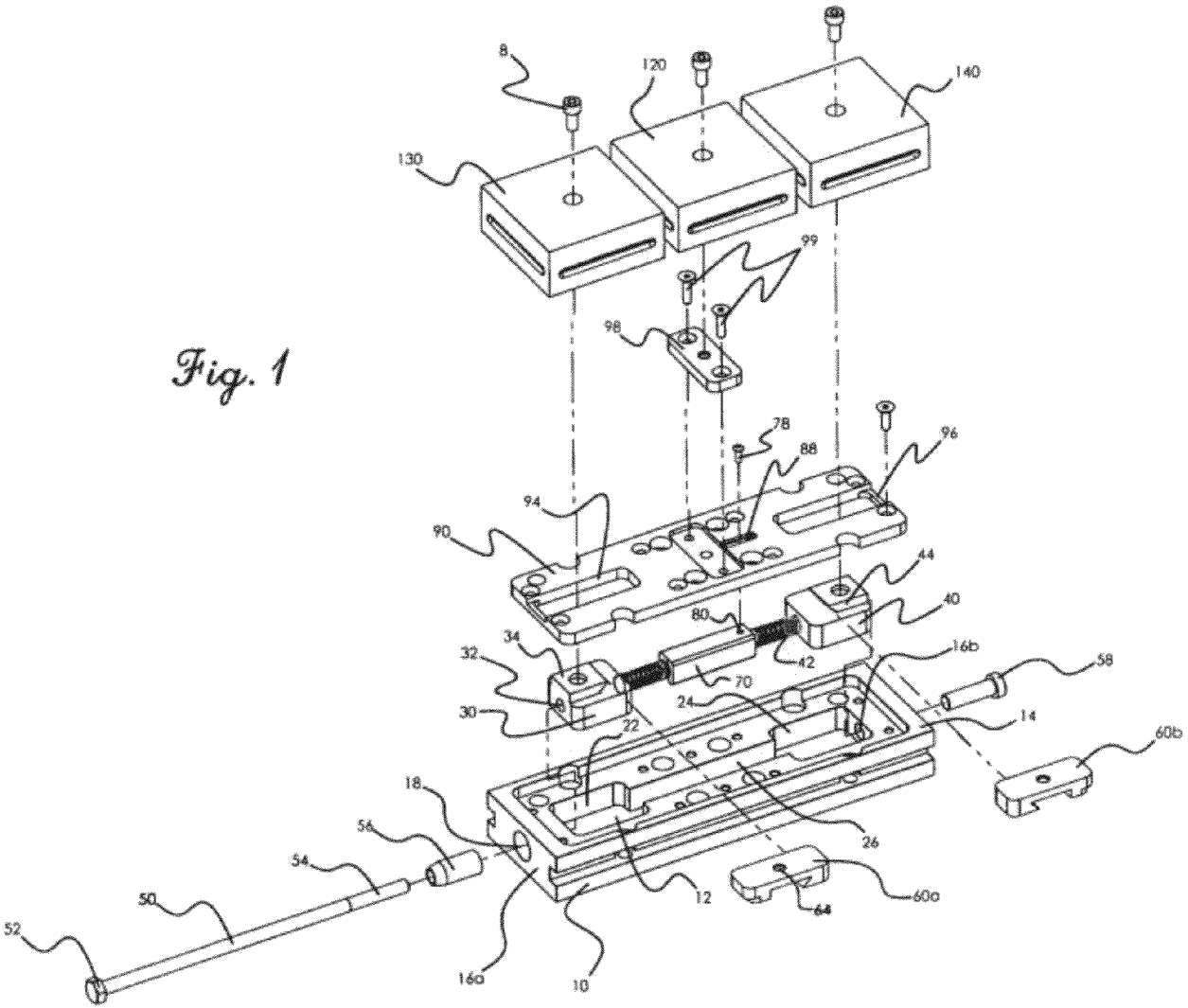
FIG. 1 illustrates a perspective exploded view of a dual-station machining vise.
Figure 2:
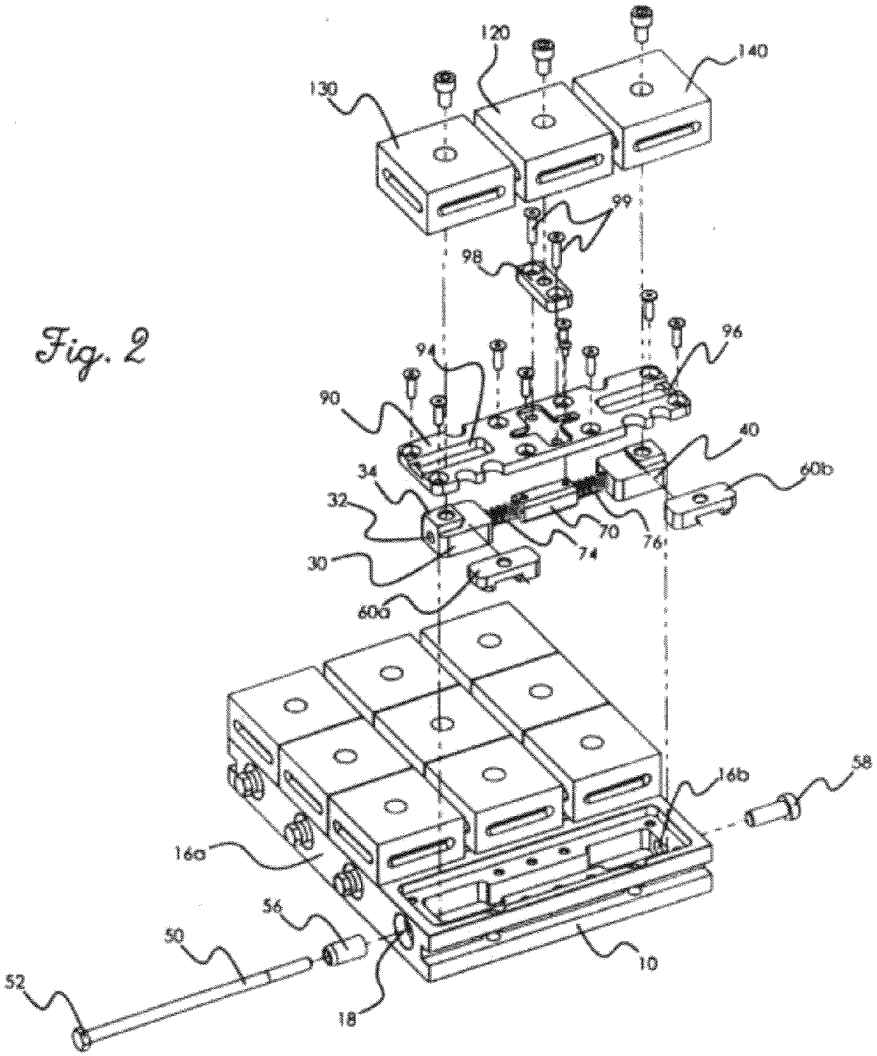
FIG. 2 illustrates a perspective partially exploded view of a multi-station machining vise.

FIGS. 1 and 2 illustrate perspective exploded views of a dual-station machine vise and a multi-station machine vise, respectively. It will be appreciated that the multi-station machine vise of FIG. 2 effectively comprises four of the dual-station vises illustrated in FIG. 1 mounted in parallel.

However, the operative components of the internal drive assemblies of both of these devices are substantially identical. For purposes of discussion, the dual-station vise of FIG. 1 is discussed, however, it will be appreciated that the discussion of the components of this dual-station vise are applicable to the multi station vise of FIG. 2.

As shown, the vise 100 has first and second movable jaws 130 and 140 that may be utilized to compress work pieces relative to a stationary central jaw 120. As shown, the base 10 includes a drive assembly recess 12 that extends from near a front wall or end 16*a* of the base 10 to the near rear wall or end 16*b* of the base 10. Of note, the drive assembly recess 12 does not extend through the floor of the base 10. Rather, the bottom of the drive assembly recess 12 defines a floor that supports the first and second slide members 30, 40, which support and controllably move the first and second movable jaws 130, 140, respectively.

The base 10 is typically machined from a single piece of metal (e.g., anodized aluminum) to provide a rigid support for the moving components of the vise 100. Generally, the drive assembly recess 12 is milled through a top surface 14 of the base and extends along the longitudinal length of the vise 100. As shown, one on more apertures may be formed through the top surface 14 to secure the base 10 to an underlying structure (e.g., milling machine, etc.). The size and/or location of these apertures may vary. A top plate 90 overlays the drive assembly recess 12 when the vise is assembled. The plate 90 is conformably received in a second recess in the top surface of the base 10. The depth of this second recess is substantially the same as the thickness of the top plate 90. In this regard, when assembled, the top of the top plate 90 and the top surface of the base 10 may be substantially planar providing a surface on which the bottom of the movable jaws 130, 140 slide. In one specific embodiment, the top surface of the plate 90 extends slightly above the top surface 14 such that the movable jaws 130, 140 rest and move on the top plate 90. In such an arrangement, the top plate 90 may be hardened (e.g., without hardening the entire base) providing improved wear characteristics for the vise 100. The unitary design of the base is resistant to deformation caused by forces placed upon the machining vise during use. As such, the base and thus the vise may stand up to great forces encountered during the machining process and retain its shape to optimize movement of the drive assembly therein.

This drive assembly recess 12 houses the components of the vise 100 that effect the movement of the movable jaws. See FIGS. 1 and 3. More specifically this recess 12 houses and guides front and rear slides 30, 40 that are operatively connected to the movable jaws 130, 140, respectively. The front slide 30 and rear slide 40 are disposed within front and rear compartments 22, 24 of the drive assembly recess 12, respectively. That is, these front and rear compartments 22, 24 are sized to receive the main body of the front and rear slides 30, 40 and provide a guide over a portion of the longitudinal axis of the recess 12.

The front and rear slides 30, 40 are connected by a drive screw 50 that operatively moves the slides 30, 40 in a controlled manner. As shown, the drive screw 50 includes an elongated shaft that, when the vise is assembled, passes through an opening 18 in the front wall 16*a* of the base 10, passes through an aperture 32 in the main body of the front slide 30, passes through a biasing block 70 and passes into a threaded aperture in the rear slide 40. In the illustrated embodiment, the drive screw 50 is formed as a bolt having has a hex head 52 on a front end and a threaded portion 54 on its distal end. When tightened, the drive screw 50 compresses the slides 30, 40 together, which causes the jaws 130, 140 to move toward the centrally located stationary jaw 120. When released, the drive screw allows the slides 30, 40 move away from one another permitting the jaws 130, 140 to retract from the centrally located stationary jaw 120.

Figure 3:
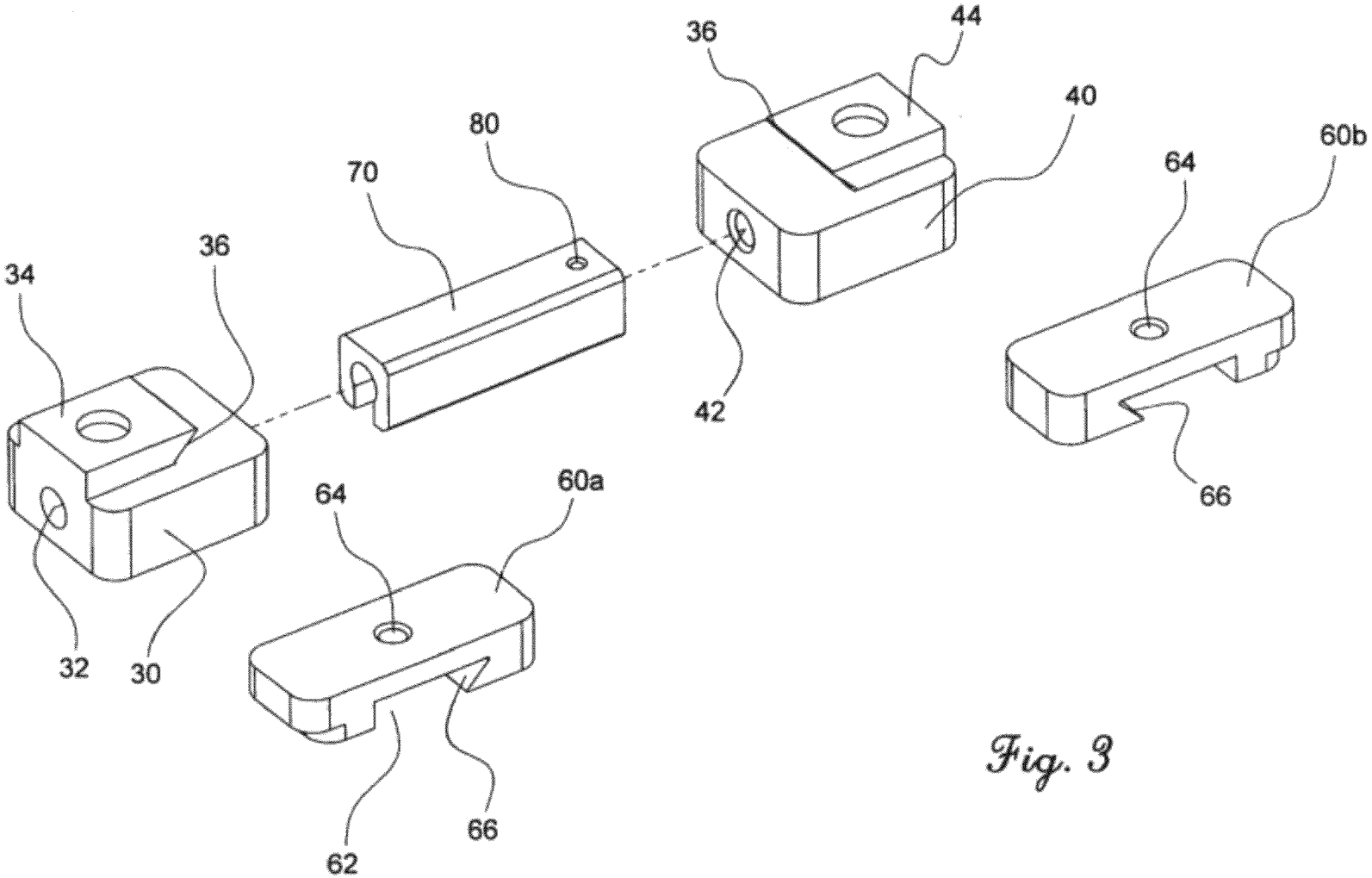
FIG. 3 illustrates one embodiment of portion of the drive assembly that carries the jaws of the vise of FIG. 1.
Figure 4A:
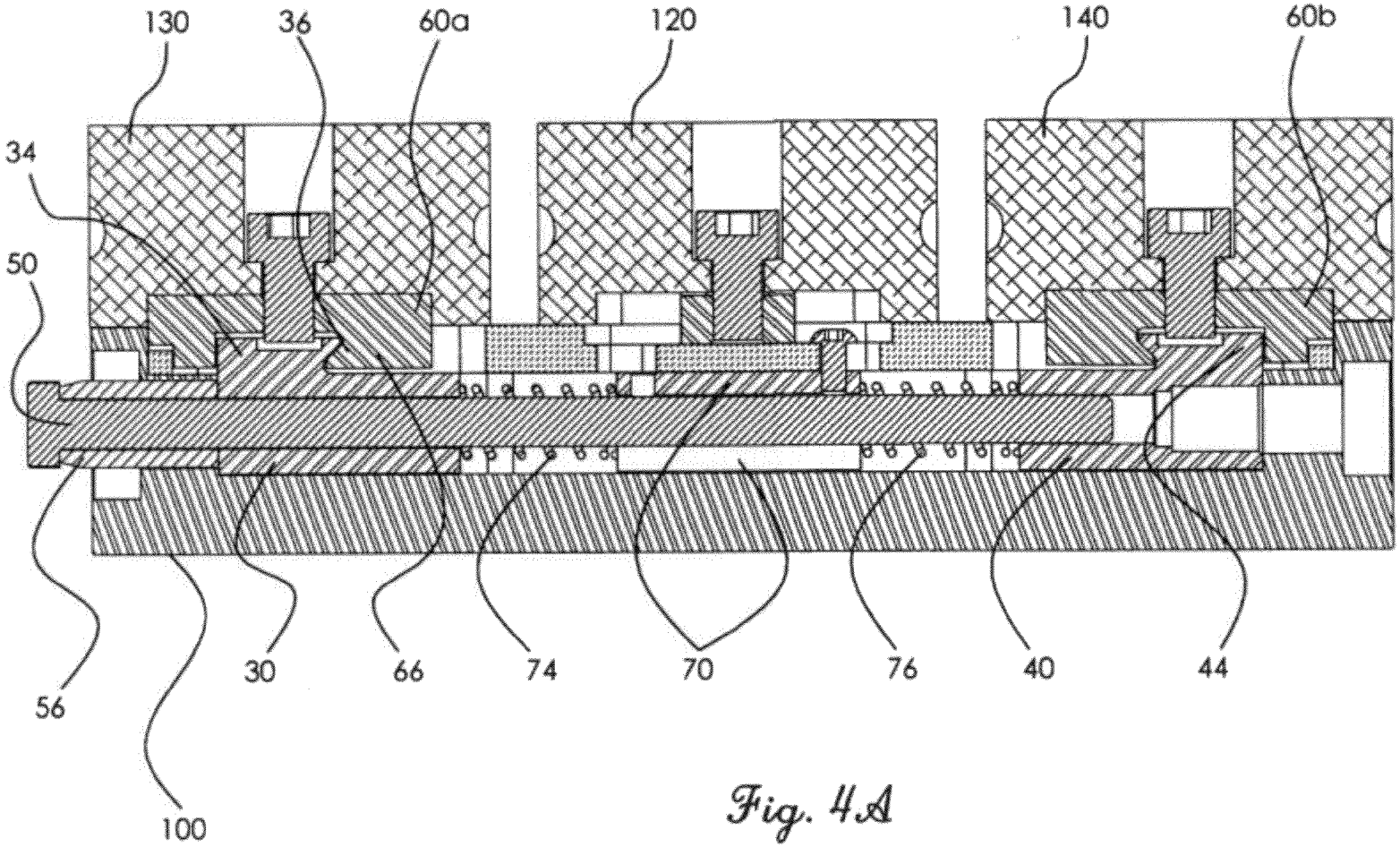
FIG. 4A illustrates a cross-sectional side view of the vise of FIG. 1.

Referring to the cross-sectional view of FIG. 4A in conjunction with FIGS. 1 and 3, the disposition of the drive screw 50 through the components of the vise 100 is better illustrated. As shown, the drive screw 50 passes through an aperture 32 in the front slide 30, through a central aperture of the biasing block 70 (the function of which is discussed herein) and into an aperture 42 the rear slide 40. More specifically, the threaded portion 54 of the drive screw 50 is received within a front threaded portion of the aperture 42 of the rear slide 40. In contrast, the drive screw 50 passes through the aperture 32 of the front slide 30 free of threaded engagement. In order to apply a compressive force to this front slide 30 for compressing the slides together as the screw is tightened, an annular collar or spacer 56 is disposed on the drive screw 50 between the screw head 52 and the rearward end of the front slide 30. In operation, tightening the drive screw 50 threads the threaded end 54 into the threaded portion of aperture 42 of the rear slide 40 until the annular collar 56 is compressed between the head 52 of the drive screw 50 and the rearward end of the front slide 30. At this time, continued tightening of the drive screw 50 moves the front and rear jaws 130, 140, supported by the front and rear slides 30, 40, together towards the stationary center jaw 120.

Figure 5:
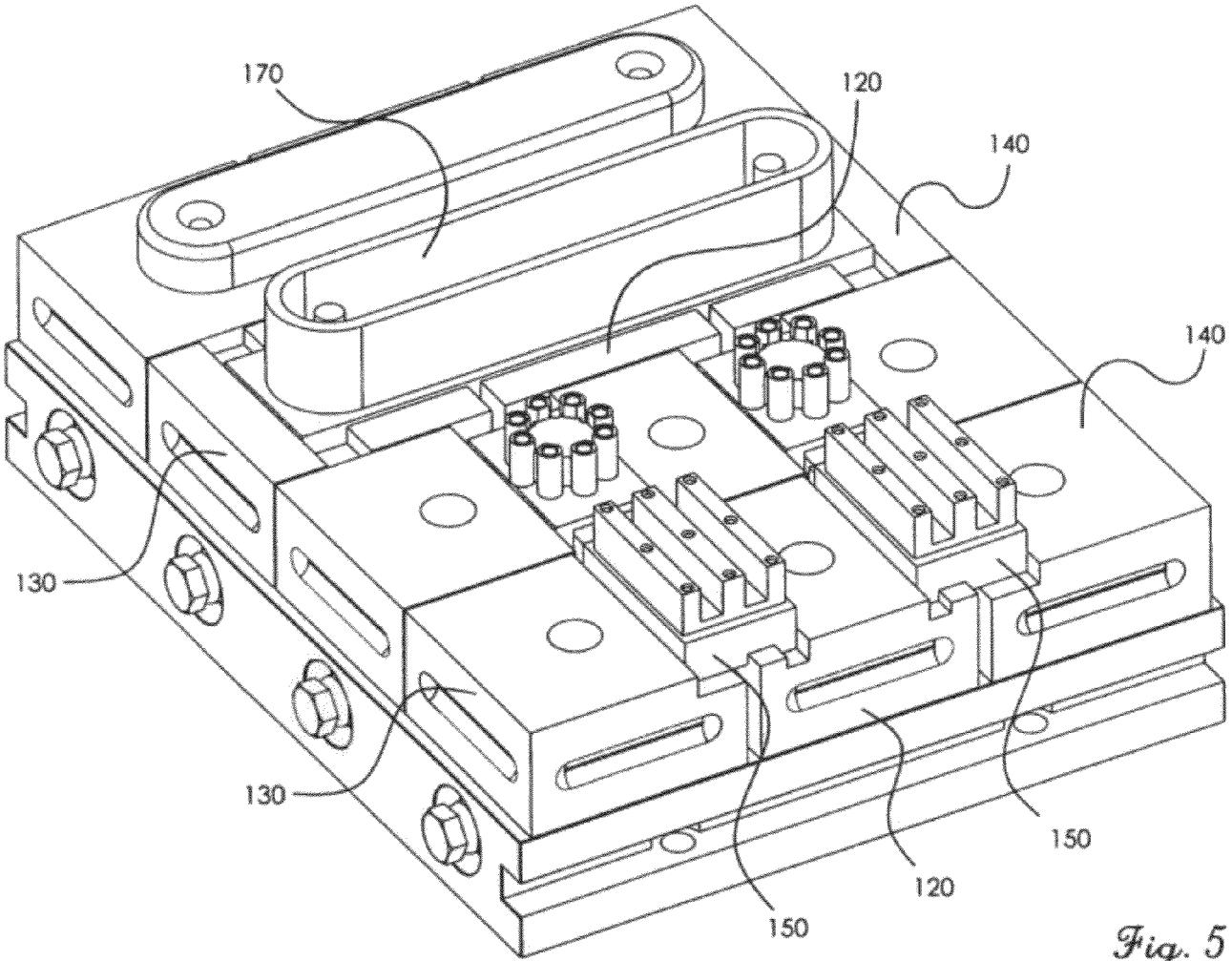
FIG. 5 illustrates soft jaws of a multi-station vise machined to hold various workpieces.

Such movement of the jaws is used to compress one or more work pieces between the movable jaws 130, 140 and the center jaw 120 or between the two movable jaws 130, 140. Referring briefly to FIG. 5, a multi-station vise is illustrated that supports one or more work pieces between movable jaws 130, 140 and/or between a movable jaw 130 or 140 and the stationary jaw 120. As will be appreciated, the use of the soft jaws allows for machining various work piece holding contours into the surfaces of the jaws 120, 130, 140. For instance, a trough may be machined through the center/stationary jaw 120 to allow a part 170 to be compressed between the movable jaws 130, 140. Alternatively, each movable jaw 130, 140 may be utilized to compress a part 150 against the center/stationary jaw 120.

Referring again to FIGS. 1, 3 and 4A, it is noted that as the front slide 30 is not engaged to the drive screw 50 in a threaded interface, the front slide 30 and jaw 130 do not necessarily retract upon loosening the threaded drive screw 50 from a rear slide 40. That is, as there is not a threaded engagement (e.g., reverse thread) between the front and rear slides 30, 40, it is necessary to use a biasing force to spread these slides 30, 40 and their associated jaws 130, 140 upon opening the vise 100 (e.g., retracting the threaded drive screw). In the present embodiment, this biasing force is provided by a biasing assembly which includes a biasing block 70 and first and second biasing elements, which in the present embodiment are first and second coil springs 74, 76. As shown in FIG. 4A, when the vise 100 is assembled, the drive screw 50 passes through the front and rear coil springs 74, 76, as well as the central aperture of the biasing block 70. As shown, the springs 74, 76 are compressed between the facing ends (e.g., forward ends) of the first and second slides 30, 40 and the respective ends of the biasing block 70. Accordingly, when the vise 100 is opened by retracting the drive screw 50, the springs 74, 76 expand and provide a biasing force that spreads apart the first and second slides 30, 40 and their respective jaws 130, 140. As illustrated in FIG. 1, the biasing block 70 is disposable within a neck 26 portion of the drive assembly recess 12 between the first and second compartments 24, 26 that receive the front and rear slides 30, 40. This neck 26 provides a guide for a biasing block 70.

Figure 4B:
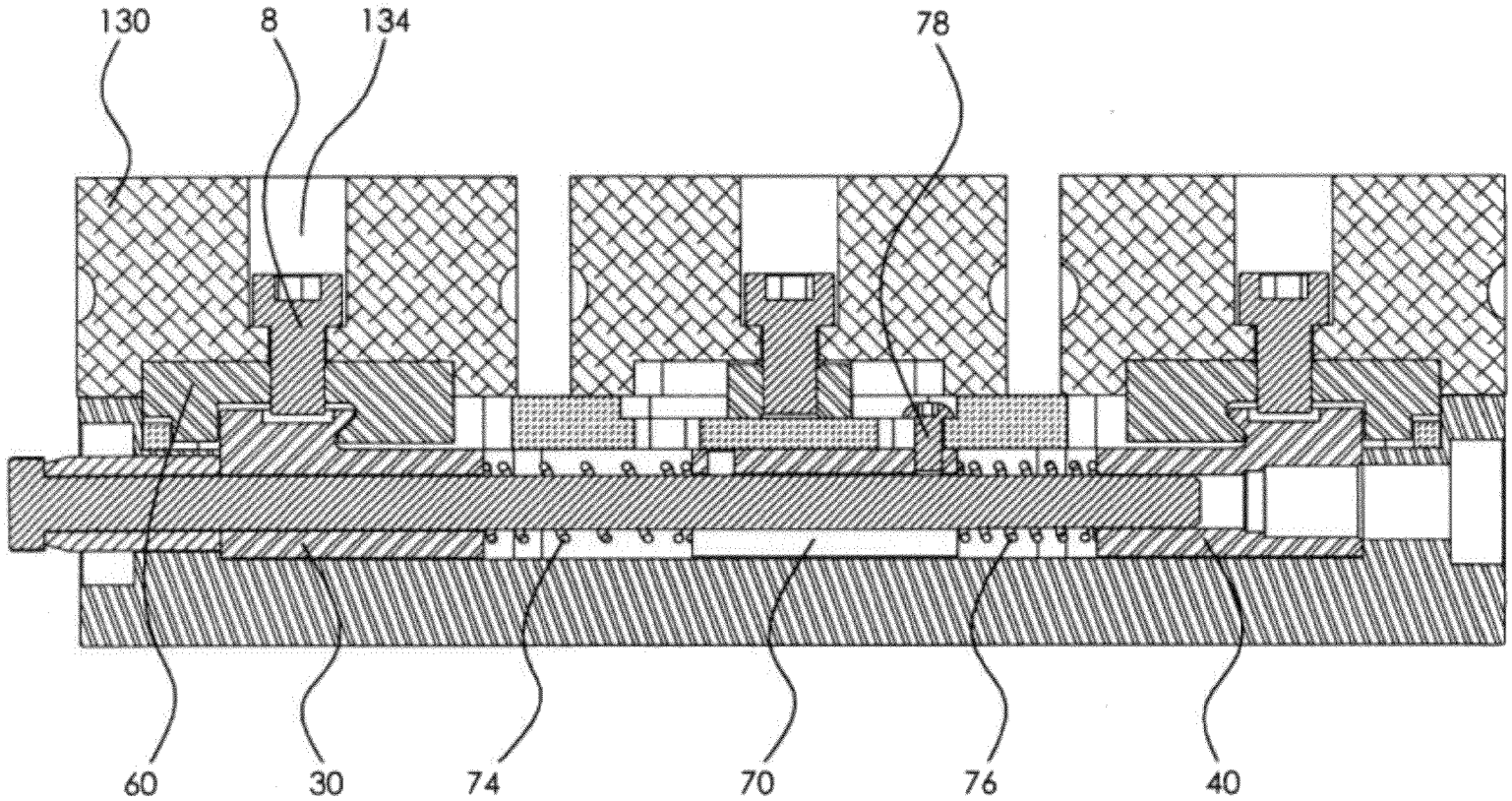
FIG. 4B illustrates a cross-sectional side view of the vise of FIG. 1 with a biasing assembly selectively biasing one of the jaws.
Figure 4C:
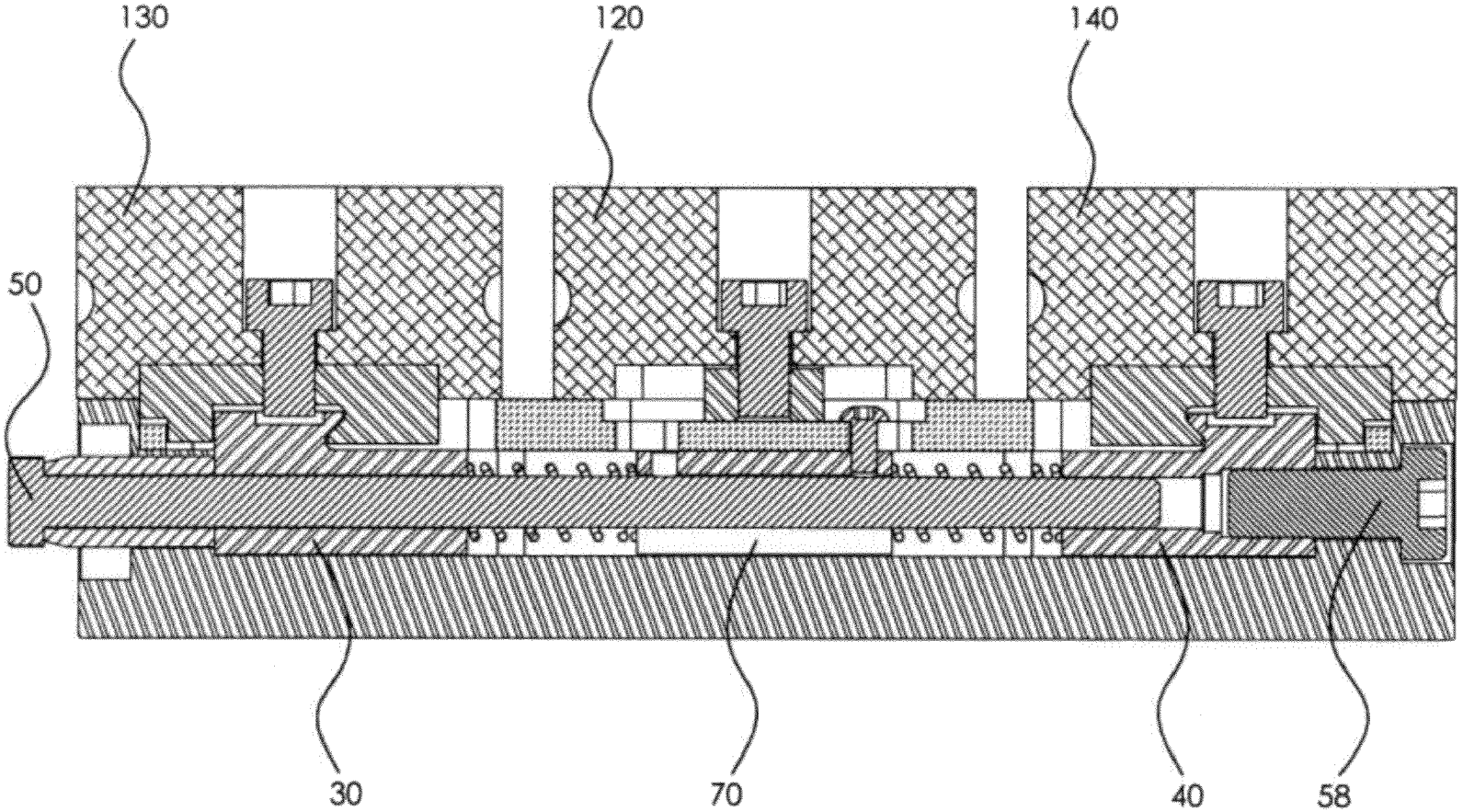
FIG. 4C illustrates a cross-sectional side view of the vise of FIG. 1 the rear jaw affixed to make the vise a single-station vise.

The slip fit arrangement between the front slide 30 and the drive screw 50 provides another benefit for the vise 100. Specifically, the lack of a threaded engagement between the front and the rear slides 30, 40 allows for fixing the rear slide 40 and jaw 140 such that only the front slide and associated jaw 130 move. As illustrated in FIG. 4C, a maintaining bolt or screw 58 may pass through an aperture in the rear wall 16*b* of the base 10 and engage a second threaded or rearward portion of the aperture 42 in the rear slide 40. This may allow for locking the rear slide 40 against the back wall 16*b* of the base. In such an arrangement, advancement or retraction of the drive screw 50 results only in the movement of the front slide 30 and its associated jaw 130. This effectively transforms the multi-station vise into a single station vise.

The biasing assembly also provides an additional function for the vise 100. Specifically, the biasing assembly allows for selectively initiating movement of one of the slides and supported jaws prior to initiating movement of the other slide and supported jaw. As illustrated in FIG. 4B, the length of the biasing block 70 is less than the length of the neck 26 of the recess 12. By moving this block 70 towards one of the slides 30 or 40, the spring between that slide 30 or 40 and the biasing block 70 experiences a greater compression than the other spring. For instance, by moving the biasing block 70 towards the rear slide 40, the second spring 76 experiences more compression than the first spring 74 (See FIG. 4B). The result of this increased compression of one spring in relation to the other spring is that upon tightening the drive screw 50, the lesser compressed spring will compress until the compression between the springs 74 and 76 is substantially equal. In the present case where the second spring 76 is initially more compressed, drive screw tightening results in the first spring 74 compressing and the first slide 30 and jaw 130 moving before the second slide 40 and jaw 140 begin moving. Once the compression of the springs equalizes, both slides and jaws move at an equal rate. Upon loosening the drive screw 50, the movement of the two jaws is also different. That is, the jaw having a more compressed spring between its slide and the biasing block will move prior to movement of the other jaw.

To permit the selective adjustment of the tension between the first and second (e.g., front and rear) springs 74, 76, the biasing block 70 includes a locking assembly. In the present embodiment, the locking assembly includes a threaded screw or bolt 78 that may be selectively engaged into a threaded aperture 80 in the biasing block 70. This threaded element 78 extends through an elongated slot 88 in the top plate 90, which overlays the drive assembly recess 12. See FIG. 1. Accordingly, the threaded element 78 may be loosened and moved along the length of the elongated aperture 88 within the top plate 90. When the threaded element 78 is disposed within the threaded aperture 80 of the biasing block 70, moving the threaded element along the elongated aperture 88 moves block 70 along the longitudinal axis of the neck 26 portion of the of the drive assembly recess 12. That is, the biasing block 70 may be moved along the neck 26 of the recess 12 to a desired position to apply a greater compressive force against either one of the slides 30, 40. When positioned in a desired location, the threaded element 78 may be tightened and thereby maintain the biasing block 70 in a desired location.

As shown in FIG. 1, the top plate 90 is received in a plate recess that surrounds the drive assembly recess 12 in the top surface of the base 10. One purpose of the plate 90 is to prevent particulates from entering into the drive assembly. However, it will be appreciated that in order for the slides 30, 40 to engage the movable jaws 130, 140, a portion of these slides must extend through the top plate 90. As shown in FIGS. 1 and 4A, each slide 30, 40 includes a head portion 34, 44 that extends above the main body of each respective slide. Further, this head portion engages a jaw carrier 60 that extends above slide apertures 94, 96 in the top plate 90.

In the disclosed vise 100, each slide 30, 40 engages a jaw carrier 60*a*, 60*b* (hereafter 60 unless specifically identified), which are each received in recess in a bottom surface of the movable jaws 130, 140. Importantly, the interface between the head portion of the slide and a bottom recess of the jaw carrier provides a pull-down effect for the jaw. It will be appreciated that the front and rear slides 30, 40 and their jaw carriers 60*a*, 60*b* are mirror copies. Accordingly, for purposes of discussion herein, the pull-down effect provided by the interface between the slide and jaw carrier is limited to discussion of the front slide assembly. However, it will be appreciated that discussion is equally applicable to the rear slide assembly.

Referring again to FIGS. 3 and 4A, the interface between the slide 30 and the jaw carrier 60 is discussed. As shown, the jaw carrier 60 includes a recess 62 in its bottom surface that is shaped to receive the head section 34 of the slide 30. The head section 34 includes an undercut lip 36 that, in operation, complimentarily engages an overcut lip 66 of the jaw carrier 60. These lips 36, 66 generally form mating wedge surfaces that extend across the width of the slide 30 and jaw carrier 60. These mating lips 36, 66 are formed such that, when the slide 30 and the supported jaw 130 are advanced towards the stationary center jaw 120, the wedge surfaces of these mating lips engage and provide a pull-down effect for the moving jaw 130.

It will be appreciated that during operation of the vise when a work piece is disposed between the jaws 130, 120 and the drive screw 50 is advanced a clamping force is applied to the work piece and a reactionary outward force is applied to the jaws 130, 120. Generally, the fixed interconnection of the stationary jaw 120 to the base 10 effectively counteracts the reactionary force and prevents movement of the stationary jaw. However, due to the movable interconnection of the slide 30, the reactionary force as applied to the moving jaw 130 (e.g., applied a counterclockwise torsional force) tends to lift the moving jaw 130. The lifting force applied to the moving jaw can, in some instances, result in a work piece moving slightly from a desired location such that precision milling of that work piece may be compromised.

This jaw lift is counteracted by the pull-down engagement of the mating lips 36, 66 of the slide 30 and the jaw carrier 60. That is, upon tightening the drive screw 50 the downwardly angled wedge design of the slide lip 36 works to apply a downward force (e.g., a clockwise torsionary force) to the mating lip 66 of the jaw carrier 60 which is transferred to the moving jaw 130. This force counteracts the lifting force applied to the moving jaw 130 that is caused by clamping a work piece between the moving jaw 130 and the stationary jaw 120. That is, the mating angled wedge surfaces of the lips 36, 66 apply a counteractive force to the moving jaw 130 that works to eliminate the jaw lift caused by compressing a work piece between the moving jaw 130 and the stationary jaw 120. The same is true for the second moving jaw 140 and the stationary jaw 120.

As shown, the recess in the jaw carrier 60 is sized to conformably receive the head section 34 of the slide 30. Specifically, the jaw carrier 60 is engaged with the slide 30 during assembly of the vise 100 where the jaw carrier 60 is engaged from a lateral side of the slide 30 such that the head portion of the slide 30 is received within the bottom recess of the jaw carrier 60. Once disposed within the jaw carrier 60, the engaged jaw carrier 60 and slide 30 are disposed within the recess 12 of the base 10 and the top plate 90 is connected to the base 10. The jaw carrier 60 extends through the top plate aperture 94. When the top plate 90 engages the base 10, the jaw carrier 60 is prevented from moving laterally such that the jaw carrier 60 may not be removed from the slide 30. That is, upon assembly of the vise 100 these elements 30, 60 remain engaged even though they are not directly mechanically connected using, for example a fastener such as a bolt. Stated otherwise, other than the slip fit engagement between the recess of the jaw carrier 60 and the head portion 34 of the slide 30, there is no direct physical interconnection between these members.

The jaw carrier 60 is receivable in a recess in the bottom of the jaw 130. To provide a conformal fit for effectively transferring the pull down force to the jaw 130, the outside perimeter (e.g., peripheral edge) of the upper surface of the jaw carrier 60 is correspondingly shaped with at least the forward and rearward ends of the recess in the jaw 130. When disposed in the recess, the top surface of the jaw carrier 60 is typically in direct contact with the bottom surface of the recess.

Figure 6:
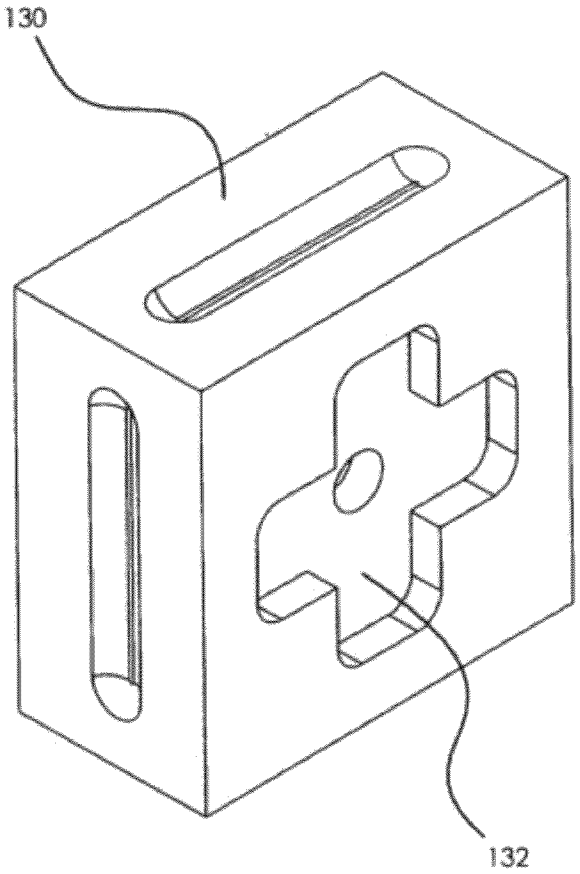
FIG. 6 illustrates a bottom perspective view of a soft jaw.

As shown in FIG. 6, the recess 132 in the bottom surface of the jaw 130 is a cruciform recess 132. However, it will be appreciated that in other embodiments a single recess may be utilized. In the present embodiment, each arm of the cruciform recess 132 is shaped to complimentarily receive the forward and rearward ends of the jaw carrier 60. The recess may be machined to have a tolerance of about 0.001 of an inch between the outside periphery of the jaw carrier 60 and the inside edges of the recess. That is, the jaw carrier 60 and recess 132 are precisely machined such that there is little or no movement between the jaw carrier 60 and the jaw 130. Further, as illustrated in FIG. 4B, the jaw includes a central aperture 134 that is sized to receive a threaded bolt 8 that engages a corresponding aperture 64 on the jaw carrier 60.

As shown in FIG. 4, when the bolt 8 is disposed within these apertures, the jaw 130 and jaw carrier 60 are mechanically coupled. Of note, the bolt 8 that couples the jaw 130 and the jaw carrier 60 does not physically interconnect with the slide 30. In this regard, the jaw 130 is not fixedly interconnected to the slide 30. That is, the interface between these elements allows for some movement between the slide 30 and the jaw carrier 60 to affect the desired pull-down effect.

As the jaw carrier 60, which is disposed between the slide 30 and the jaw 130, provides the pull-down effect for the jaw 130, the manufacture of the jaw may be simplified. That is, previous jaws have often included complex structures such as undercut and/or overcut lips to provide a pull-down effect for the jaw. Incorporation of such structures (e.g., lips, etc.) into a jaw significantly increases the complexity of producing such jaws, which by their nature are made for periodic replacement. That is, each time a jaw is replaced, the recess formed in the new jaw requires milling of a specialized structure or feature to provide the desired pull-down effect. In the present vise 100, the pull-down effect is provided by the interface between the jaw carrier 60 and the slide 30. These parts do not need replacement when a new jaw 130 is needed.

In the presented embodiment, the interface between the peripheral edge surfaces of the jaw carrier 60 and the peripheral edges of the recess 132 are perpendicular relative to the to the planar bottom surface of the jaw 130. That is, outside peripheral edges of the jaw carrier 60 are substantially vertical. By utilizing such vertical sidewalls for the peripheral edge of the jaw carrier, the recess formed in the bottom of the soft jaw 130 may include vertical sidewalls free of any undercuts or other specialized structures thereby simplifying the machining required for such a jaw. Through a locking lip engagement between the jaw carrier and the jaw, the conformal recess fit between these elements transfers the pull-down from the jaw carrier to the jaw.

Use of the cruciform recess 132 in the bottom surface of the jaw 130 provides an additional benefit, namely, the ability to utilize each face of the jaw. As shown, both arms of the cruciform recess 132 are equally sized and may be selectively utilized to receive the jaw carrier 60. This allows for turning the jaw 130 such that any of the four faces thereof may be disposed toward the stationary jaw 120. As shown in FIG. 5, soft jaws are often specially milled to hold one or more work pieces between the movable jaw 130 and the stationary jaw 120. The ability to use each face of the jaw 130 allows a jaw to be reused for multiple different applications or stored for repeat use in the future. This reduces the replacement frequency for the jaws.

A further advantage of the vise 100 is that all three jaws 120, 130 and 140 (i.e., both movable jaws and the stationary jaw) are identical. That is, the stationary jaw 120 is identical to each of the moving jaws 130, 140. This provides a benefit that only one jaw need to be produced for use with all three locations on the vise 100. As illustrated in FIG. 1, the stationary jaw 120 is mounted to a mid portion of the vise 100. More particularly, a locator 98 having the same outside periphery as the jaw carrier(s) 60 is mounted near a center point of the vise 100. More specifically, this locator is mounted to the base 10 through apertures in the top plate 90 via first and second bolts 99. This locator 98 includes a threaded central aperture for receiving a threaded element (e.g., bolt or screw) to mechanically attach the stationary jaw 120 to the base 10. As all three jaws are identical, a machine shop need only produce or inventory a single jaw style.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A machining vise, comprising:

a base having a recess, wherein the base recess defines a longitudinal axis and a bottom surface of the base defines a reference plane;

a stationary jaw removably mounted to the base;

a first slide disposed in the base recess for selective movement along the longitudinal axis, the first slide including a body and a slide carrier head extending above the body, the slide carrier head having an undercut lip;

a first jaw carrier including:

a recess in a lower surface sized for receiving the slide carrier head, the recess having an overcut lip for complementary engagement with the undercut lip of the slide carrier head; and an upper surface having an outside peripheral edge; and a first jaw having a recess in a bottom surface, the first jaw recess being sized to conformably receive the outside peripheral edge of the upper surface of the first jaw carrier.

2. The machine vise of claim 1, wherein:

the outside peripheral edge of said first jaw carrier is substantially perpendicular to the reference plane when the slide carrier head is disposed in the first jaw carrier recess; and the inside edge surfaces of the recess in the first jaw are substantially perpendicular to the bottom surface of the first jaw and are free of undercutting.

3. The vise of claim 1, wherein the outside peripheral edge of the upper surface of the first jaw carrier is disposed in parallel with mating portions of the inside edge surfaces of the recess in the bottom surface of the first jaw.

4. The vise of claim 3, wherein a tolerance between the outside peripheral edge of the upper surface of the first jaw carrier and mating portions of the inside edge surfaces of the recess in the bottom surface of the first jaw are about 0.001 inches.

5. The vise of claim 1, wherein the outside peripheral edge of the upper surface of the first jaw carrier is oblong.

6. The vise of claim 5, wherein the recess in the bottom surface of the first jaw is cruciform, wherein the cruciform recess is sized to receive the outside peripheral edge of the oblong jaw carrier in first and second orientations.

7. The vise of claim 1, further comprising:

a fastener, the fastener passing through an aperture in the first jaw and engaging a threaded aperture in the first jaw carrier, wherein the fastener is adapted to secure the first jaw carrier relative to the recess in the bottom surface of the first jaw.

8. The vise of claim 1, wherein the overcut lip comprises a first wedge surface and the undercut lip comprises a second wedge surface, wherein a portion of the second wedge surface is disposed above a portion of the first wedge surface when the slide carrier head is disposed in the recess of the jaw carrier.

9. The vise of claim 1, further comprising:

a second slide disposed in the base recess and including a body and a slide carrier head extending above the body, the slide carrier head having an undercut lip;

a second jaw carrier including a recess in a lower surface sized for receiving the second slide carrier head, the second jaw carrier recess having an overcut lip for complementary engagement with the undercut lip of the slide carrier head; and a second jaw having a recess in a bottom surface, the second jaw recess being sized to conformably receive an upper surface of the second jaw carrier;

wherein first and second slides are disposed in the base recess on opposing sides of the stationary jaw and wherein the first and second jaws are disposed on opposing sides of the stationary jaw.

10. A dual station machining vise, comprising:

a base having a recess, wherein the base recess defines a longitudinal axis and a bottom surface of the base defines a reference plane;

a stationary jaw removably mounted to the base and disposed over a portion of the base recess;

first and second slides movably disposed in the base recess on opposing sides of the stationary jaw, the slides each including a head portion having an undercut lip;

first and second jaw carriers, each including a recessed lower surface for receiving the head portion of a corresponding one of the slides, wherein the recessed lower surface includes an overcut lip for complementary engagement with the undercut lip of the corresponding slide;

first and second jaws, each having a recess in a bottom surface for conformably receiving an outer periphery of a respective one of the jaw carriers, wherein edge surfaces of the first and second jaw recesses are substantially perpendicular to the bottom surface and free of undercutting; and a mounting element mounted to the base for locating the stationary jaw, wherein the stationary jaw includes a recess in a bottom surface for conformably receiving the mounting element, and wherein an outer periphery of the mounting element is the same as the outer periphery of the first and second jaw carriers.

11. The vise of claim 10, wherein the first jaw, the second jaw and the stationary jaw are identical.

12. The vise of claim 10, further comprising:

a biasing block disposed in the base recess below the stationary jaw and between the first and second slides; and first and second biasing elements disposed between the biasing block and the first and second slides, respectively.

13. The vise of claim 12, further comprising:

a locating assembly for affixing the biasing block at a desired position between the first and second slides.

14. The vise of claim 13, wherein the locating assembly comprises:

an elongated aperture through a surface at least partially enclosing the base recess; and a threaded element that extends though the elongated aperture for receipt within a threaded aperture in the biasing block.

15. A machining vise, comprising:

a base having a recess;

a stationary jaw removably mounted to the base over a portion of the base recess;

a first slide disposed in the base recess, the first slide including a main body having an aperture therethrough, wherein a first jaw is removably mounted to the first slide and disposed on a first side of the stationary jaw, a second slide disposed in the base recess, the second slide including a main body having an aperture therethrough, wherein a second jaw is removably mounted to the second slide and disposed on a second side of the stationary jaw, a biasing block disposed in the base recess below the stationary jaw and between the first and second slides;

first and second biasing elements disposed between the biasing block and the first and second slides, respectively;

a locating assembly for locating the biasing block at a position along the length of the recess between the first and second slides; and a drive screw extending through a first end of the base and passing through the aperture of the first slide and being received in a first threaded portion of the aperture of the second slide.

16. The machine vise of claim 15, wherein the second slide further comprises:

a second threaded portion; and a threaded element for extension through a second end of the base for selective engagement with the second threaded portion of the second slide, wherein when the threaded is selectively engaged with the second threaded portion of the second slide, the second jaw is fixed.

17. The vise of claim 15, wherein the locating assembly comprises:

an elongated aperture through a surface at least partially enclosing the base recess; and a threaded element that extends though the elongated aperture for receipt within a threaded aperture in the biasing block.

18. The vise of claim 15, wherein the drive screw passes through an aperture in the biasing block.

19. The vise of claim 18, wherein the drive screw passes through the first and second biasing elements.

* * * * *